US006163923A

United States Patent [19]

Hefter

[11] Patent Number: 6,163,923

[45] Date of Patent: Dec. 26, 2000

[54] SOIL PROCESSING MACHINE

[75] Inventor: Christian Hefter, Prien, Germany

[73] Assignee: Georg Hefter Maschinenbau, Prien, Germany

[21] Appl. No.: 09/194,187

[22] PCT Filed: Mar. 26, 1998

[86] PCT No.: PCT/EP98/01790

§ 371 Date: Nov. 24, 1998

§ 102(e) Date: Nov. 24, 1998

[87] PCT Pub. No.: WO98/43527

PCT Pub. Date: Oct. 8, 1998

[30] Foreign Application Priority Data

Mar. 27, 1997 [DE] Germany ..... 197 13 123

[51] Int. Cl.[7] ..... A47L 11/202

[52] U.S. Cl. ..... 15/340.4; 15/320; 15/385; 15/401

[58] Field of Search ..... 15/320, 340.4, 15/401, 385

[56] References Cited

U.S. PATENT DOCUMENTS

| | | | |
|---|---|---|---|
| 4,173,056 | 11/1979 | Geyer | 15/320 |
| 4,317,252 | 3/1982 | Knowlton | 15/320 |
| 4,492,002 | 1/1985 | Waldhauser et al. | 15/320 |
| 4,854,005 | 8/1989 | Wiese et al. | 15/320 |
| 5,265,300 | 11/1993 | O'Hara et al. | 15/320 X |
| 5,455,895 | 10/1995 | Hamline et al. | 15/401 |
| 5,495,638 | 3/1996 | Zachhuber | 15/320 X |
| 5,524,320 | 6/1996 | Zachhuber | 15/320 |
| 5,623,743 | 4/1997 | Burgoon et al. | 15/320 |
| 5,970,571 | 10/1999 | Ochss | 15/320 |

FOREIGN PATENT DOCUMENTS

| | | |
|---|---|---|
| 0 705 558 A1 | 4/1996 | European Pat. Off. . |
| 91 15 713 U | 3/1992 | Germany . |
| 43 37 633 | 5/1995 | Germany . |

*Primary Examiner*—Chris K. Moore
*Attorney, Agent, or Firm*—Nixon & Vanderhye

[57] ABSTRACT

The invention relates to a soil processing machine comprising a driveable soil processing device (5) with a non-circular processing encompassing at least one processing body (5*a*, 5*b*) and preferably also comprising a following suction strip (25') which can pivot d a vertical axis in relation to said soil processing machine. The invention is characterized in that the soil processing machine (5) can around a vertical rotational axis (19) in addition to the corresponding pivoting non-circular processing surface depending upon the ion of travel.

18 Claims, 5 Drawing Sheets

Fig. 10
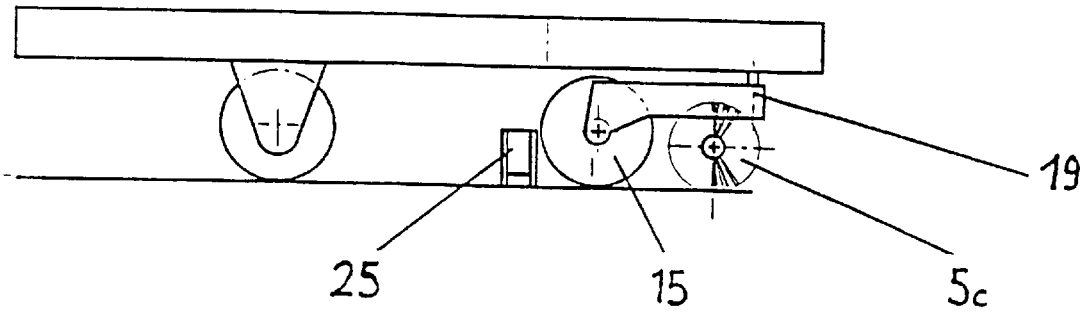
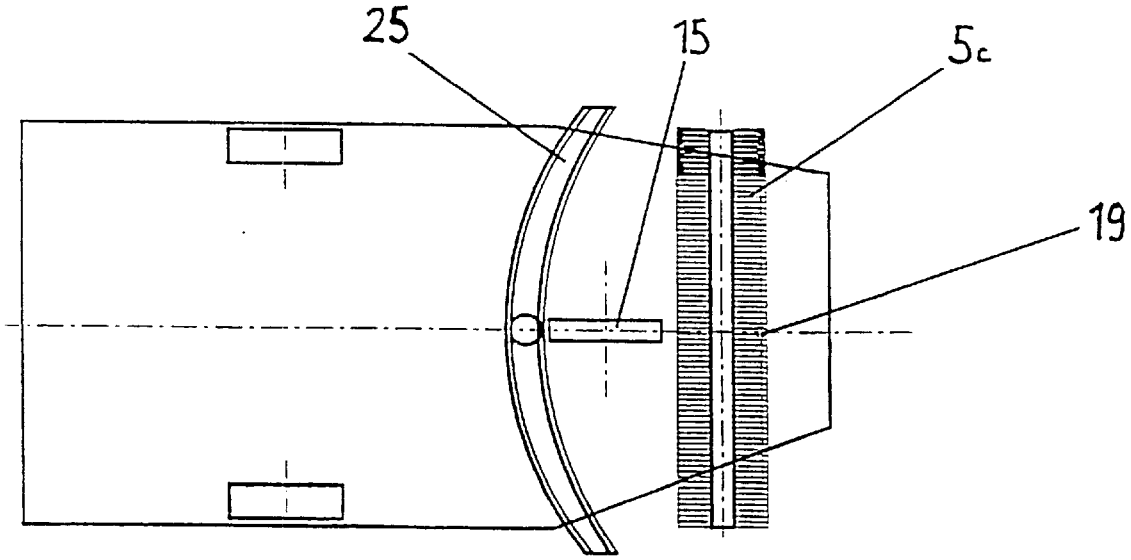
Fig. 11

SOIL PROCESSING MACHINE

A ground-treatment machine establishing the generic type has been disclosed, for example, by DE 43 37 633 C2. It comprises a ground-treatment device having a non-circular overall treatment area. As is the practice in such ground-treatment machines, a suction strip is arranged in a trailing position relative to the ground-treatment device, and this suction strip is suspended from a retaining arm which is pivotably mounted about a vertical axis. In this case, the vertical axis for the trailing and pivotably suspended suction strip lies centrally between the axes of rotation of two main brushes.

Although such ground-treatment implements have in principle proved very successful in practice, the object of the present invention is to provide a ground-treatment machine which is improved still further compared with said ground-treatment implements.

With comparatively simple means, the present invention brings about improvements which hitherto were not thought to be possible.

The ground-treatment machine according to the invention comprises a ground-treatment device having a non-circular treatment area, for example in the form of two disk brushes arranged next to one another. This ground-treatment device is now arranged so as to be pivotable about a vertical axis.

Furthermore, it is taken into account that the treatment device having the non-circular treatment area may normally consist of two disk brushes which lie next to one another relative to the direction of travel and can be driven in opposite directions; thus, for the present invention, this means that, even during curvilinear travel of the ground-treatment machine, these ground-treatment bodies, for example in the form of disk brushes, remain oriented transversely to the direction of travel in each case with their very much larger overall transverse extent. As a result, during curvilinear travel, even right into corners and out again, the ground can be treated or cleaned with the treatment body over as wide an area as possible and also in a fully effective manner.

An associated suction strip is also preferably jointly pivoted with the pivotable treatment device, as a result of which the water soaking solution, applied to the ground for example, can be sucked up in an optimum manner. In this case, the suction strip may be pivoted together with the entire ground-treatment device in a fixed spatial allocation or else may again be suspended so as to float relative thereto, at least within a small angular range.

In a coordinated solution, it has proved to be especially favorable if the ground-treatment device having the at least one treatment body also comprises a running wheel which is jointly pivoted with the ground-treatment body. This running wheel, due to the weight bearing on it (from the chassis of the ground-treatment machine), builds up transverse forces which allow the rotation to take place in a defined manner, and without the running wheel sliding or slipping away transversely. If this at least one running wheel is arranged between the treatment bodies of the ground-treatment device and the suction strip trailing relative thereto, especially optimized running behavior results, since, in the most confined spatial regions, the trailing suction strip can swing out laterally by lateral pivoting of the ground-treatment machine. In this case, it is also possible to configure the entire arrangement in such a way that the entire ground-treatment device can rotate by 360°. The result of this is also that, in a small spatial region, a changeover can be effected from forward travel via slight lateral travel to reverse travel, with the result that the suction strip, e.g. in the smallest space, can be pivoted by 180° and comes to lie in a trailing position again during reverse travel.

Especially favorable proportions are achieved in particular in the connection of a ground-treatment device, pivotable as a body and having a non-circular ground-treatment area, together with a jointly pivotable suction strip, with an additional running wheel for support.

The pivoting movement of the ground-treatment device, for example in the form of two disk brushes lying next to one another, is preferably effected via a trailing suction strip (in particular if no additionally pivotable running wheel is provided), or else via a pivotable running wheel which is arranged so as to be pivotable together with the ground-treatment device and is oriented in a trailing position relative to the common vertical rotation axis. Due to the trailing orientation, the running wheel not only adjusts itself automatically in accordance with the desired direction of travel but consequently also accordingly orients the ground-treatment body, in each case with its optimum leading treatment side, transversely to the direction of travel.

In the case of a machine having a driver's seat, the appropriate orientation of the ground-treatment bodies in the respective direction of travel may be effected by coupling the steering wheel or the steering device to the vertical rotation axis.

The invention is explained below with reference to an exemplary embodiment. In the drawing, in detail:

FIG. 10 shows a schematic side representation of a modified exemplary embodiment with the use of a cylinder brush; and FIG. 11 shows a plan view of a horizontal cross section through the exemplary embodiment according to FIG. 11 at the level of the horizontal axis of rotation of the cylinder brush.

Figure 1:
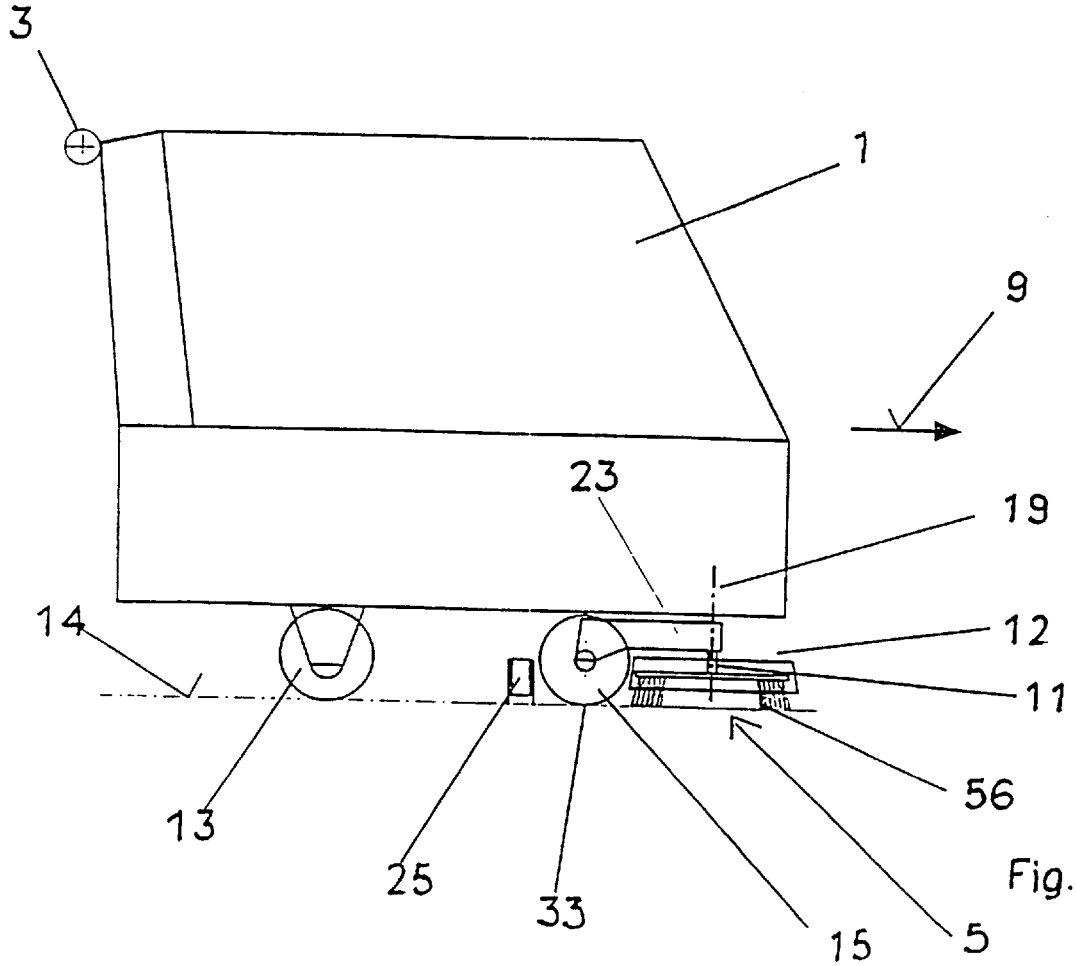
FIG. 1 shows a schematic side view of a ground-treatment machine according to the invention.

Shown in the figures is a ground-treatment machine, which normally comprises a machine or housing body 1, an operating unit 3 arranged in a trailing position, and at least one motor in the machine and housing body 1, via which motor, treatment bodies 5*a* and 5*b* of a ground-treatment device 5 can be driven. In the exemplary embodiment shown, the treatment bodies 5*a* and 5*b* are two disk brushes, which can be driven in opposite directions in accordance with the arrow representation 7 (FIG. 2) about drive axes 11 disposed vertically to the drawing plane, i.e., perpendicularly to the ground.

The drive direction is normally such that, in the forward-travel direction 9, the disk brushes rotate in an advancing manner toward one another.

The two disk brushes 5*a*, 5*b*, shown in the exemplary embodiment, of the ground-treatment device 5 may be accommodated in a so-called brush box 12, which essentially covers the two disk brushes 5*a*, 5*b* except for the region of their drive axes 11 and ends above the ground 14.

In the exemplary embodiment shown, the ground-treatment machine comprises two rear, non-steerable wheels 13 and a third pivotable wheel 15 leading relative thereto, via which the ground-treatment implement is held and can be moved.

The rear wheels 13 are supported and held on the underside of the ground-treatment machine or on the associated chassis of the same.

The ground-treatment device 5 comprising the two treatment bodies 5*a* and 5*b* is now pivotable about a vertical rotation axis 19, the rotation axis 19 being pivotably mounted at least indirectly on the machine or housing body 1 or on the associated chassis of the ground-treatment machine.

In the exemplary embodiment shown, the two circular ground-treatment bodies 5*a*, 5*b*, relative to the center longitudinal axis 21 of the ground-treatment machine, lie exactly next to one another at the same height during rectilinear forward travel. However, an arrangement in which the two treatment bodies 5*a*, 5*b* are at least slightly offset in the longitudinal direction of the ground-treatment machine or in the direction of travel, in such a way that the area swept in each case by the treatment bodies 5*a*, 5*b* overlaps, is also possible.

Firmly connected to the vertical rotation axis 19 is a retaining arm 23, which is arranged in a trailing position and to the end of which a suction strip 25 is fastened in a central position and is made to follow said retaining arm 23.

In the exemplary embodiment shown, the suction strip 25 is firmly connected to the retaining arm 23 at the fastening point 27, so that the two ground-treatment bodies 5*a*, 5*b* of the retaining arm 23 and the suction strip 25 form a ground-treatment device 5 which is rotationally fixed as a unit and pivots jointly about the vertical rotation axis 19.

As can also be seen from the drawings, the leading third wheel 15 is also supported on the retaining arm 23, specifically between the two treatment bodies 5*a*, 5*b* and the trailing suction strip 25. In the exemplary embodiment shown, the leading wheel 15 is non-pivotable relative to the retaining arm 23 but is rotatable together with the latter about the vertical rotation axis 19. The vertical rotation axis 19 lies in the center longitudinal plane or intersects the vertical center longitudinal axis 21 of the ground-treatment machine, and in fact preferably at the point of intersection between the line, which connects the two drive axes 11 of the ground-treatment bodies 5*a*, 5*b*, and the center longitudinal axis 21.

Finally, liquid, in particular cleaning liquid, is fed to the disk brushes via a line (not shown in any more detail), preferably in or at the region of the ground-treatment bodies 5*a*, 5*b*, for example directly upstream of the disk brushes in the forward-travel direction or so as to drip onto the disk brushes or through the central axis into the central region of the disk brushes, as a result of which a trailing liquid film, which is to be picked up again from the ground and is also called water soaking solution 29 below, is produced, and this liquid film is drawn off from the ground by the trailing suction strip and is delivered via a suction hose (not shown in any more detail) to a suction device accommodated in the ground-treatment machine, i.e., in the machine and housing body 1.

Figure 2:
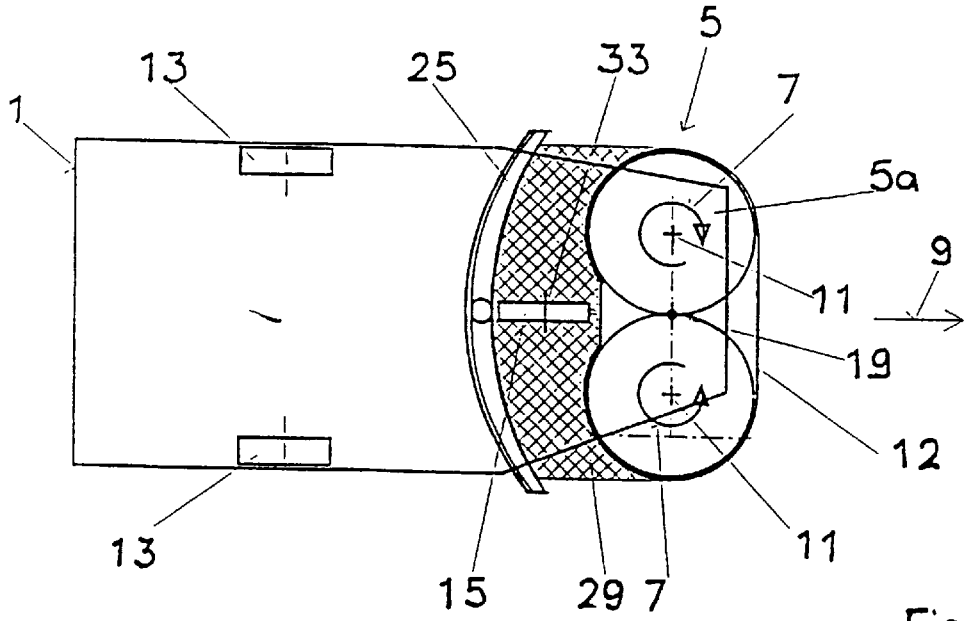
FIG. 2 shows a schematic horizontal section approximately at the level of the wheels of the treatment implement.

FIG. 2 shows the normal rectilinear travel, during which the liquid film 29 referred to can be sucked up via the suction strip 25. In this case, the suction strip 25 has a width which is preferably at least slightly wider than the maximum width of the entire treatment bodies 5*a* and 5*b*. In the exemplary embodiment shown, the suction strip 25 is slightly wider than the overall width of the ground-treatment machine.

If a left-hand or right-hand curve is to be negotiated by the ground-treatment implement, appropriate pressure to the left or the right can be exerted via the rear operating unit 3 (which comprises, for example, a handlebar running transversely to the treatment implement) in such a way that the front wheel 15 (which, however, is arranged in a trailing position relative to the vertical rotation axis 19) is correspondingly pivoted about this vertical rotation axis 19. At the same time, however, the entire ground-treatment device 5, with the two ground-treatment bodies 5*a*, 5*b*, the front wheel 15 running with the latter, and the trailing suction strip 25, is likewise pivoted jointly about the common vertical rotation axis 19 in such a way that, even during curvilinear travel, the ground can be treated and cleaned with the maximum width extent of the treatment bodies 5*a* and 5*b*. Since the main weight rests on the front pivotable wheel 15, for example, in the exemplary embodiment shown, a weight of 500 N compared with a bearing weight of 300 N in the region of the brushes, it also turns out that the respective rolling point 33 at the leading wheel 15 is the point of application for the pivoting of the ground-treatment device 5.

Thus, for cleaning corners, for example, the ground-treatment device, while remaining virtually at the same location, can be pivoted to the left with its leading region, in which case, during left-hand pivoting, the leading vertical rotation axis 19 is taken along to the left with the entire ground-treatment machine. In the process, the front wheel 15, while remaining virtually at the same location, is jointly pivoted to the left in alignment with the rotation axis 19, as a result of which the entire ground-treatment device 5 and the vertical rotation axis 19 perform the desired pivoting movement to the left.

Figure 3:
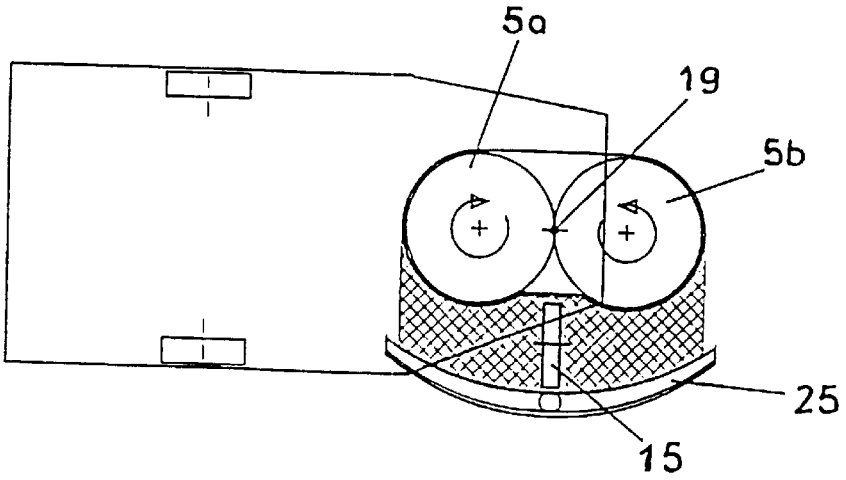
FIG. 3 shows a sectional representation corresponding to FIG. 2 during 90° curvilinear travel to the left.
Figure 4:
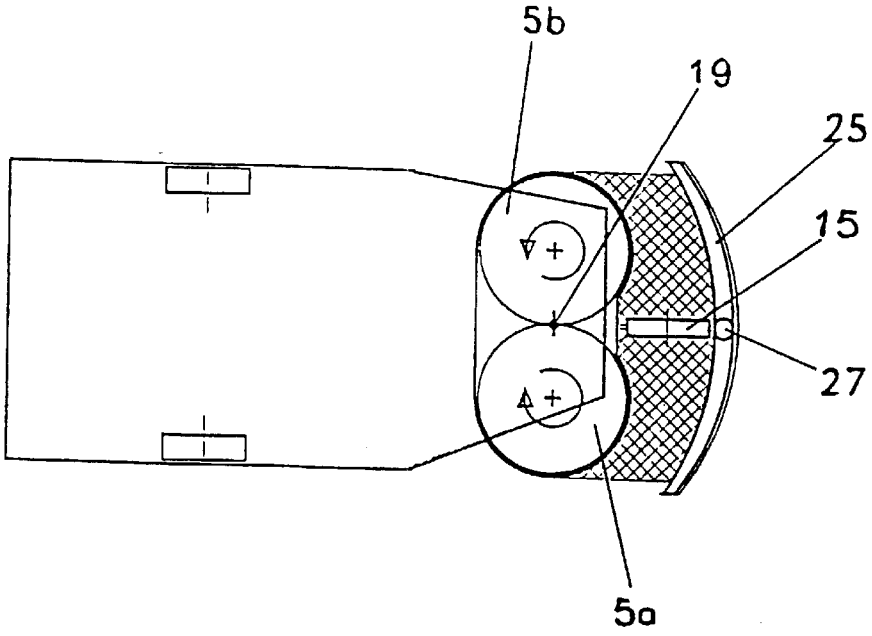
FIG. 4 shows a further corresponding sectional view during reverse travel.

As a result, not only the disk brushes 5*a*, 5*b* but also the suction strip 25 can be pivoted by, for example, 90° in the smallest space (which has great advantages when a corner is to be cleaned), but they can also be pivoted by, for example, 180° (as shown in FIG. 4) if, starting from the position in FIG. 3, the ground-treatment implement is moved in the reverse direction.

In this case, the arrangement may be such that the ground-treatment device 5 can be rotated back and forth as desired by 360° about the vertical rotation axis 19.

Due to the construction explained, not only is optimum ground treatment achieved with the maximum width extent of the disk brushes 5*a*, 5*b* lying next to one another, but it is also additionally ensured that the suction strip, in each case in the directly trailing region, is made to follow the two treatment bodies 5*a*, 5*b*, lying next to one another, in order to be able to optimally pick up the water soaking solution.

It is noted in principle that the steerable front running wheel 15 mentioned need not necessarily be arranged between the disk brushes and the suction strip but may also be arranged in the trailing direction behind the suction strip. However, this then results in slightly different kinematics. In the case of a trailing wheel 15, the pivoting movement is effected in a more sluggish and less dynamic manner. This is because the consequence of arranging a running wheel 15 between the leading brush devices 5*a*, 5*b* and the trailing suction strip 25 is that, during a pivoting movement, with a coordinate system placed through the rolling point 33 in the running wheel 15, the vertical rotation axis 19 lies on the one side and the fastening point 27 for the suction strip 25 lies opposite on the other side of the running wheel 15, and the rotation axis 19 and the fastening point 27 are pivoted about the supporting point 33. An increasingly more extreme swing-out movement of the suction strip 25 at an already slight front lateral offset of the ground-treatment machine is achieved if the running wheel 15 and its rolling point come to lie increasingly closer to the vertical rotation axis 19.

The principle explained above has been dealt with for the case of a ground-treatment machine which is operated by a person running along behind the ground-treatment machine. In this case, the entire weight of the ground-treatment machine is supported via the two rear wheels 13 and the jointly pivotable wheel 15 arranged in a leading position in the center.

However, provided the space requirement and the weight ratios permit it, two pivotable leading wheels may also be provided instead of the one leading wheel 15. In principle, pivoting of the brush box 12 having the brush device 5*a*, 5*b* is possible together with the suction strip 25 but also without the use of a running wheel 15 assisting the pivoting movement. In other words, if sufficient space is available, one or more running wheels 15 may also be steerably attached directly to the chassis of the ground-treatment machine, if a collision with the suction strip and the disk brushes can be avoided.

Figure 5:
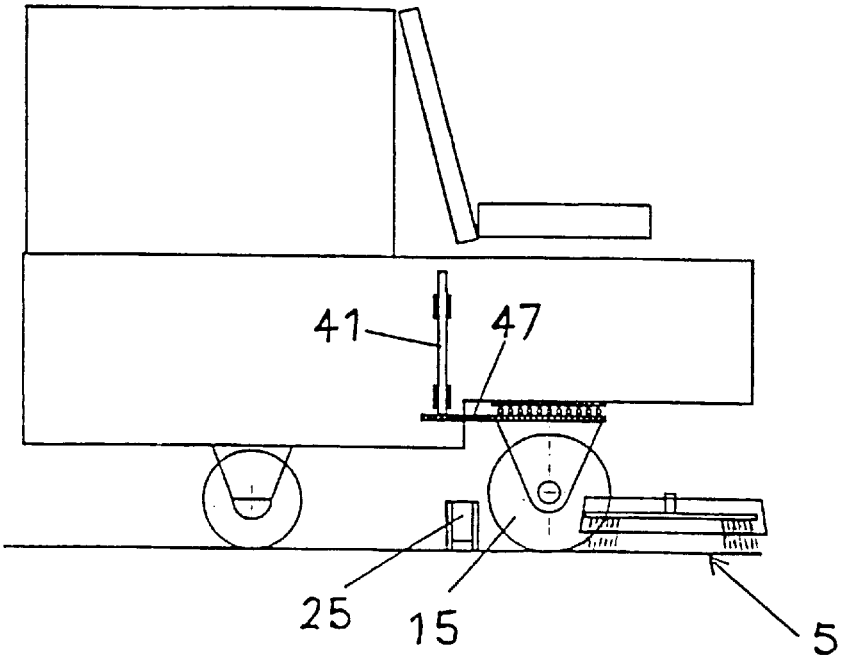
FIGS. 5 to 7 show a modification of FIGS. 1 to 3 for a machine having a driver's seat, a so-called rider machine.
Figure 6:
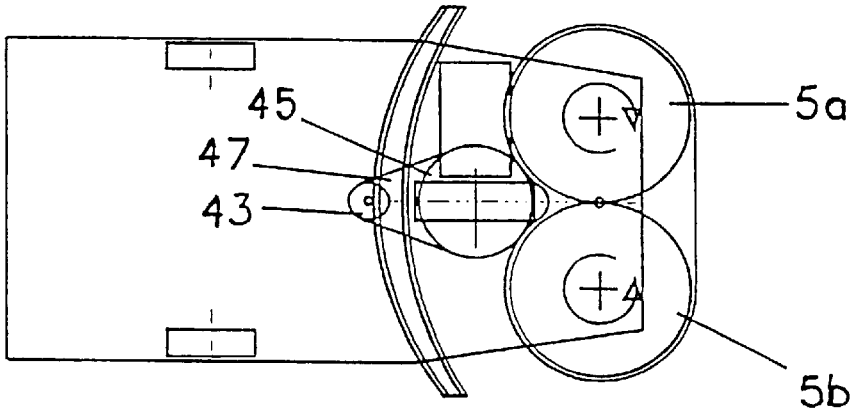
Figure 7:
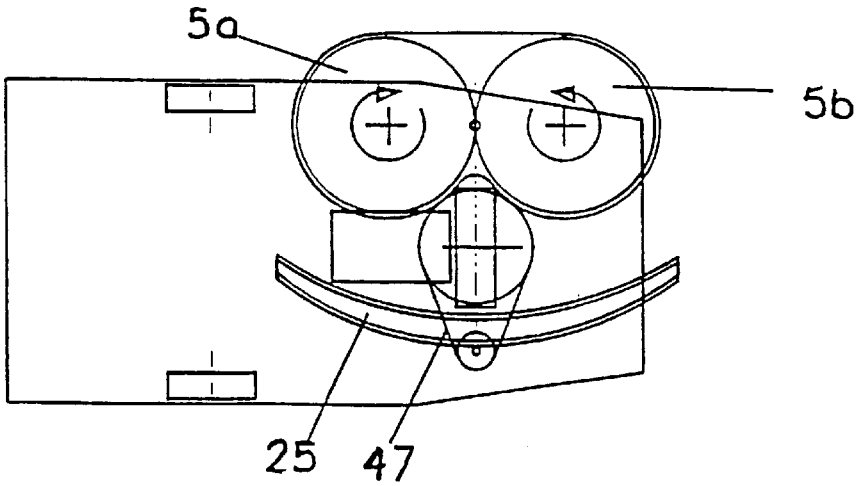

The functional principle explained, however, may also be applied in a machine having a driver's seat, as reproduced in principle in the representations according to FIGS. 5 to 7. In this case, it is possible for there to be a connection to the vertical rotation axis 19 via a steering wheel of the machine having a driver's seat, so that the machine having a driver's seat is accordingly controlled and steered by the operator via the steering wheel and thus the ground-treatment device 5, in a positively actuated manner, is jointly pivoted and adjusted with the trailing suction strip 25.

In this case, FIG. 5 schematically shows the extension of a steering rod 41, which, for example, is in steering connection with the ground-treatment device 5 via two toothed-belt pulleys 43 and 45 and a toothed belt 47 revolving via the latter. The pivotable wheel 15 is adjusted to the left and right via the steering connection in accordance with the direction of travel. The vertical adjusting axis 19 is here placed in such a way that it vertically intersects the pivotable wheel 15 and runs through the rolling point 33 of the pivotable wheel 15. Finally, in such a machine having a driver's seat, the steerable wheel may be drivable via a drive mechanism (not described in any more detail) for the propulsion of the implement, provided the rear wheels are not driven.

In this exemplary embodiment, too, the ground-treatment bodies 5*a*, 5*b* are therefore pivoted together with the pivotable wheel 15 and the suction strip 25 as a common brush and suction unit, in which case, as stated, this unit may also be connected to a drive unit for the pivotable wheel 15.

Figure 8:
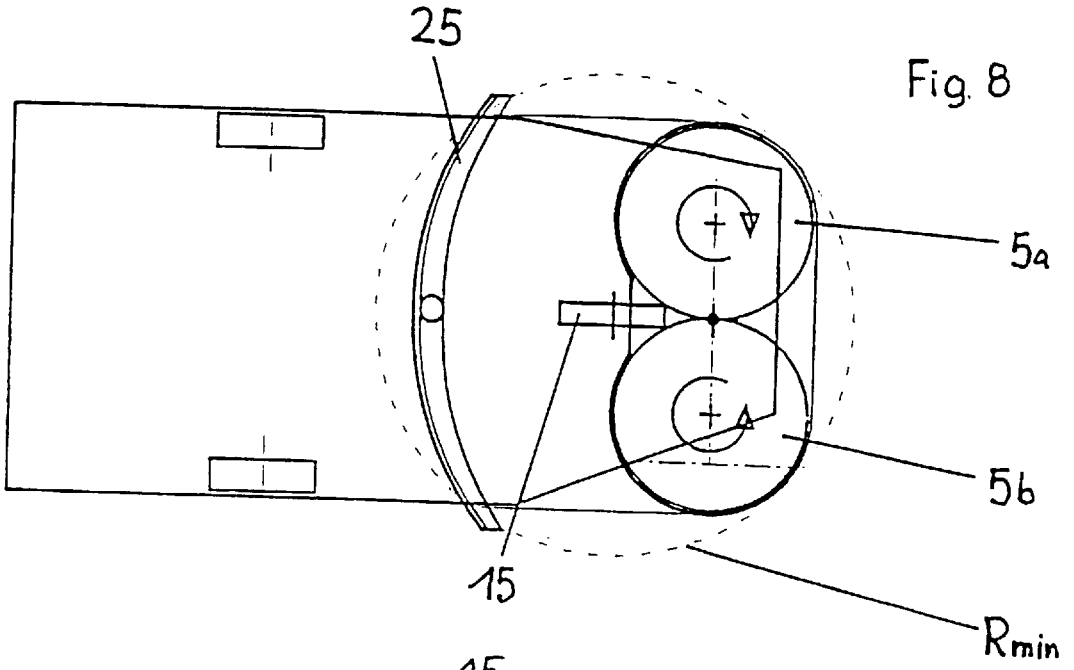
FIGS. 8 and 9 show a representation comparable with FIG. 2 for illustrating the kinematics when the wheel initiating the rotary movement is arranged in front of the suction strip according to FIG. 8 and after the suction strip according to FIG. 9.
Figure 9:
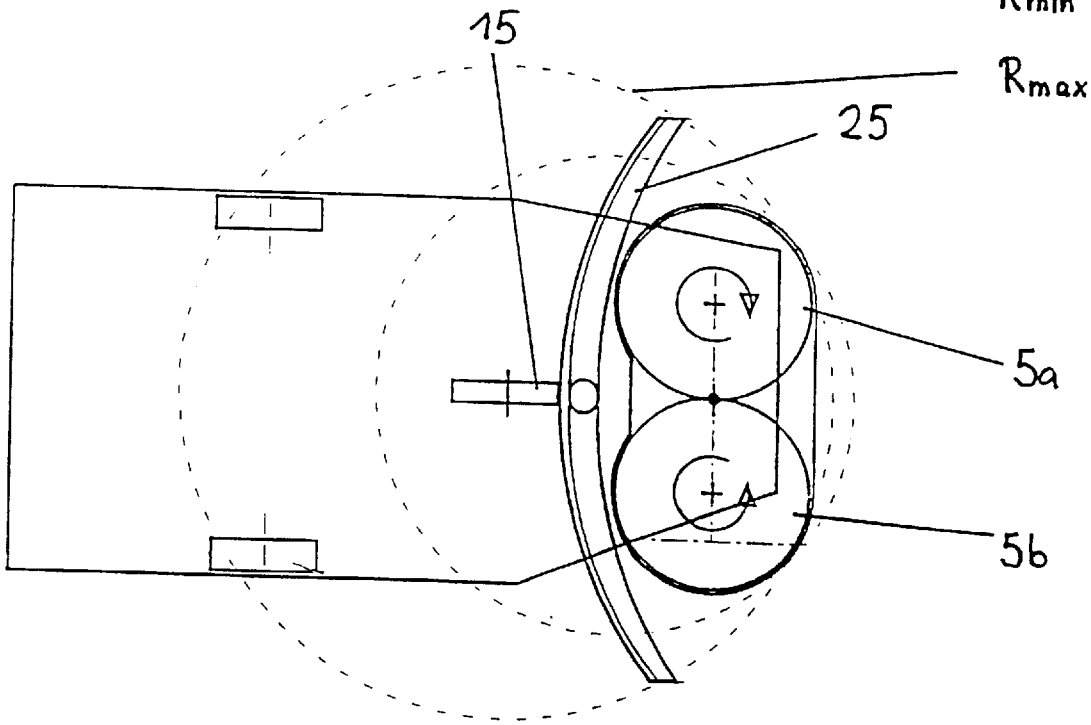

The different kinematics of the ground-treatment machine are dealt with in FIGS. 8 and 9, when, in the exemplary embodiment according to FIG. 8, which as far as the kinematics are concerned corresponds to the preceding exemplary embodiments, the wheel 15 initiating the rotary movement is arranged in front of the suction strip, i.e., at a relatively short distance behind the two rotating disk brushes 5*a*, 5*b*, and as in the exemplary embodiment according to FIG. 9, the wheel is mounted in a trailing position relative to the suction strip.

In the first-mentioned case according to FIG. 8, the pivoting radius $R_{min}$ depicted there for the suction strip is obtained. The width of the suction strip 25 is thereby also established in order to pick up the liquid film in an optimum manner over the entire suction width even during a pivoting operation.

In the exemplary embodiment according to FIG. 9, a larger pivoting radius $R_{max}$ is obtained. It can thus also be seen that a larger width of the suction strip 25 has to be selected. The first-mentioned exemplary embodiment according to FIG. 8 therefore has more favorable proportions in this respect, since the smaller, i.e., narrower, suction strip used results in a minimum clearance width in the face of obstacles, and in addition the suction capacity per se is greater, since suction need only be applied to a smaller area when the exerted suction energy of a suction motor is the same.

It is mentioned only for the sake of completeness that, instead of the two disk brushes or at least instead of one of the two disk brushes, other treatment bodies 5*a*, 5*b* may also be used, for example a disk brush and a revolving sweeping belt interacting with it, or, for example, a transversely oriented sweeping belt, or, for example, two sweeping belts arranged in a slight V-shape, one or more cylinders, one or more polishing disks, etc., cleaning being carried out mostly in the dry state in the case of polishing disks, that is, suction need not be carried out. If need be, a cleaning strip provided without a suction device could additionally be arranged instead of a suction strip.

In this respect, with reference to FIGS. 10 and 11, it is shown purely by way of example and schematically that a cylinder brush 5*c* may also be used as ground-treatment device 5, which cylinder brush 5*c* is oriented transversely to the vehicle longitudinal axis during rectilinear travel and rotates about a horizontal axis of rotation 11'. Here, too, the wheel may, of course, be fitted in a leading or trailing position.

Finally, two wheels 15 lying laterally offset from the vertical center longitudinal plane may also be used (as for a four-wheel vehicle), in which arrangement the two wheels are then preferably not provided with steering as in a vehicle (road vehicle) but are suspended non-rotatably on a common axle, in which case the common axle can be pivoted with the ground-treatment device, the suction strip and the wheels about the common vertical rotation axis 19.

Finally, it is also noted only for the sake of completeness that the suction strip 25 need not be firmly anchored and held on the retaining arm 23, for example at the fastening point 27 shown there, but that the fastening point 27 may also be designed as a floating axis in order to also permit via the latter, at least within a small angular range, an additional floating movement of the suction strip relative to the retaining arm 23. However, the fastening point, which may also be designed as a floating axis, may also be provided so as to lie very much further forward on the retaining arm 23, if need be even so as to lie very close to the vertical rotation axis 19.

What is claimed is:

1. A ground treatment machine comprising:

a drivable ground treatment device having at least one treatment body and a trailing suction strip, said device being pivotable about a vertical axis of rotation relative to the ground treatment machine, said ground treatment device having a non-circular treatment area with a lateral extent oriented transversely to the direction of travel;

said ground treatment device being pivotable with its non-circular treatment area about said vertical rotation axis relative to the machine body such that, during curvilinear travel, the lateral extent of said treatment body remains oriented transversely to the current direction of travel; said vertical rotation axis lying substantially along a vertical center longitudinal plane of the ground treatment machine and in a leading region of said ground treatment machine.

2. A ground treatment machine according to claim 1 wherein said suction strip is pivotable with said ground treatment device about said vertical rotation axis.

3. A ground treatment machine according to claim 1 including a pivotable wheel carried by said device in a trailing position relative to said one treatment body, said wheel being pivotable about the vertical rotation axis relative to the machine body and pivotable about the vertical rotation axis with said ground treatment device.

4. A ground treatment machine according to claim 1 including a pivotable wheel carried by said device in a trailing position relative to said ground treatment device, said pivotable wheel, in plan view of a ground area, having a rolling point in contact with the ground area offset in a trailing direction relative to the vertical rotation axis.

5. A ground treatment machine according to claim 4 wherein the pivoting movement of the ground treatment device is effected as a function of the position of the trailing wheel relative to the vertical rotation axis.

6. A ground treatment machine according to claim 1 including a pivotable wheel having a rolling point, in plan view of a ground treatment machine, lying between said one treatment body and said suction strip.

7. A ground treatment machine according to claim 1 including a pivotable wheel having a rolling point, in plan view of the ground treatment machine, and arranged such that said suction strip lies between said one ground treatment body and the pivotable wheel.

8. A ground treatment machine according to claim 1 wherein said device has two treatment bodies having respective drive axes transversely offset from one another relative to the direction of travel, the vertical rotation axis being located between the two drive axes of the two treatment bodies.

9. A ground treatment machine according to claim 8 wherein the vertical rotation axis is offset in one of a leading and trailing direction relative to the ground treatment device.

10. A ground treatment machine according to claim 1 wherein the ground treatment device comprises a brush cylinder rotatable about a horizontal axis transverse to the vertical center longitudinal plane during forward travel.

11. A ground treatment machine according to claim 1 wherein the suction strip is pivotable about the vertical rotation axis and about a floating axis offset from and parallel to the rotation axis.

12. A ground treatment machine according to claim 1 including a pivotable wheel carried by said device in a trailing position relative to said treatment body, said pivotable wheel being loaded with a higher pressure than the treatment bodies.

13. A ground treatment machine according to claim 1 including a retaining arm pivotable about the vertical rotation axis and a pivotable wheel carried by said arm, said suction strip and said wheel being pivotably mounted and supported on said retaining arm.

14. A ground treatment machine according to claim 1 including at least one wheel pivotable about the vertical rotation axis, a chassis for carrying said device, and further wheels attached to said chassis for supporting the ground treatment machine.

15. A ground treatment machine according to claim 1 including a driver's seat and a steering device for steering the machine.

16. A ground treatment machine according to claim 1 wherein the ground treatment device includes a supporting wheel coupled to a steering device, said ground treatment device being pivotable by operation of the steering device.

17. A ground treatment machine according to claim 15 wherein the suction strip is pivotable by operation of the steering device.

18. A ground treatment machine according to claim 1 including a pivotable wheel carried by said device in a trailing position relative to said treatment body and a drive for said one wheel mounted directly on one of said wheel and on a pivotable support device supporting the wheel.

* * * * *